US007806147B2

(12) United States Patent
Hodson

(10) Patent No.: US 7,806,147 B2
(45) Date of Patent: Oct. 5, 2010

(54) PAPERMAKERS DRYER FABRIC

(75) Inventor: Mark Adrian Hodson, Nr. Blackburn (GB)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 11/746,835

(22) Filed: May 10, 2007

(65) Prior Publication Data

US 2007/0261753 A1 Nov. 15, 2007

(30) Foreign Application Priority Data

May 12, 2006 (DE) ..... 10 2006 022 235

(51) Int. Cl.
*D03D 3/04* (2006.01)
*D21F 7/08* (2006.01)
*D03D 25/00* (2006.01)

(52) U.S. Cl. ..... 139/383 A; 139/383 R; 139/383 AA; 162/358.2

(58) Field of Classification Search ..... 139/383 R, 139/383 A, 383 AA, 408, 411, 412, 413, 139/414; 162/348, 358.1, 358.2, 900, 902, 162/903, 904
See application file for complete search history.

(56) References Cited

U.S. PATENT DOCUMENTS 4,290,209 A * 9/1981 Buchanan et al. ..... 34/123
4,621,663 A * 11/1986 Malmendier ..... 139/383 A
5,056,565 A * 10/1991 Kufferath ..... 139/383 A
5,097,872 A * 3/1992 Laine et al. ..... 139/426 R
5,100,713 A * 3/1992 Homma et al. ..... 428/102
5,361,808 A * 11/1994 Bowen, Jr ..... 139/383 A
5,364,692 A * 11/1994 Bowen et al. ..... 428/222
5,368,696 A * 11/1994 Cunnane et al. ..... 162/358.2
5,690,150 A * 11/1997 Huey et al. ..... 139/426 R
5,819,811 A * 10/1998 Baker et al. ..... 139/383 AA
5,998,310 A * 12/1999 Bowen, Jr. ..... 442/196
6,263,183 B1 * 7/2001 Schlueter et al. ..... 399/329
6,328,079 B1 * 12/2001 Zils ..... 139/383 AA
6,378,565 B1 * 4/2002 Best ..... 139/383 A
H2053 H * 12/2002 Cunnane, III ..... 162/348
6,837,276 B2 * 1/2005 Josef et al. ..... 139/383 A
6,899,143 B2 * 5/2005 Rougvie et al. ..... 139/383 A
7,008,512 B2 * 3/2006 Rougvie et al. ..... 162/348
7,300,554 B2 * 11/2007 LaFond et al. ..... 162/348
2007/0261753 A1 * 11/2007 Hodson ..... 139/383 A

* cited by examiner

*Primary Examiner*—Bobby H Muromoto, Jr.
(74) *Attorney, Agent, or Firm*—Bachman & LaPointe, P.C.

(57) ABSTRACT

The present disclosure relates to a papermakers dryer fabric (C to G) adapted to carry a paper web on one fabric surface thereof and woven from machine direction yarns (1) and cross machine direction yarns (2; 6.1, 6.2; 15, 16) wherein the yarns (1, 2; 6.1, 6.2; 15, 16) cross over each other to create void volume (V.T, V.U1, V.U2) both inside the structure (T) of the fabric (C to G) and at the surfaces (U.1, U.2) of the fabric (C to G). The machine direction yarns (1) and the cross machine direction yarns (2; 6.1, 6.2; 15, 16) are interlaced so that virtually all of the void volume (V.U1, V.U2) is exposed to the paper web carrying and non-paper web carrying surfaces (U.1, U.2).

25 Claims, 5 Drawing Sheets

PAPERMAKERS DRYER FABRIC

BACKGROUND OF THE INVENTION

The present invention relates to a papermakers dryer fabric adapted to carry a paper web on one fabric surface thereof and woven from machine direction and cross machine direction yarns wherein the yarns cross over each other to create void volume both inside the structure of the fabric and at the surfaces of the fabric.

Generally speaking papermaking machines are made from up to three sections, namely forming, pressing and drying sections. By the time the paper web enters the drying section from the pressing section, as much as fifty percent of the water has been removed from the paper web. The remaining water removal is then completed in the dryer section. Here the paper web is carried by dryer fabrics transferring the paper web in succession from one to another of the rotating surfaces of sections of steel cylinders arranged along the length of the machine which are heated by high pressure steam.

The so far known papermakers dryer fabrics have the disadvantage that contaminants from the paper making process become trapped within the fabric structure. This reduces the permeability and effectiveness of the fabric: both sheet runnability and tail feeding are adversely affected due to reduced transmission of under pressure through the fabric to the paper web. Drying efficiency and uniformity of drying are adversely affected due to contaminants making the fabric surface uneven, or the lower permeability reduces ventilation and extraction of air/water vapour during the drying process.

High pressure water showers can be used to loosen the contaminants and remove them within the flow of water to a "save all" tray or by suction at an extraction zone. If the fabric is dirty then the papermaker can increase the water pressure. However too much water to clean the fabric will cause the fabric to run wet causing uneven moisture profiles and wet streaks in the paper. The removal of the water and contaminants is also difficult because the water and contaminants are held within the voids of the fabric structure.

SUMMARY OF THE INVENTION

It is therefore an object of the present invention to provide a papermakers dryer fabric where both excess water and suspended contaminants should no longer be trapped in the voids inside the structure of the fabric and the contaminants are more exposed to the fabric surfaces for ease of cleaning. The overall contamination of the fabric should therefore be significantly reduced.

In accordance with the invention, this object is satisfied by the provision that the machine direction yarns and the cross machine direction yarns are interlaced so that virtually all of the void volume is exposed to the paper web carrying and non-paper web carrying surfaces.

This will result in the effect that the water and suspended solids will be in the surface void volume areas facilitating easier removal to a save all tray or by extraction. Furthermore, excess water and suspended contaminants will no longer be trapped in void volume inside the structure of the fabric resulting in a higher dryness of the dryer fabric and therefore also in the paper web.

In a first preferred embodiment, if using a machine direction yarn of 0.67 mm wide, the internal void volume beneath at least one layer of a machine direction yarn and inside the structures ranges from 0 to 0.9 $mm^3$, preferably from 0 to 0.5 $mm^3$ and most preferably from 0 to 0.05 $mm^3$ and/or from 0 to 3,000 $mm^3/100\ mm^2$ and preferably from 0 to 250 $mm^3/100\ mm^2$. The void volume inside the structure of the fabric is per definition defined as a void between machine direction yarns, cross machine direction yarns or both machine direction and cross machine direction yarns where there is space between two or more surfaces. These voids can be completely enclosed by one or more surfaces resp. planes or have an opening between these surfaces, where the said opening is narrower than the length of the shortest surface in the void.

In a second preferred embodiment, the void volume at the surfaces of the fabric ranges from 0 to 10,000 $mm^3/100\ mm^2$ and preferably from 2,500 to 10,000 $mm^3/100\ mm^2$. The void volume at the surfaces of the fabric is per definition defined as non-structural void between machine direction yarns, cross machine direction yarns or both machine direction and cross machine direction yarns where there is space between two or more surfaces. These voids have an opening between these surfaces, where the said opening is wider than the longest surface of the void.

Additionally, the total void volume as defined by addition of the structural and surface void volumes ranges preferably from 100 $mm^3/100\ mm^2$ to 3,500 $mm^3/100\ mm^2$.

Moreover, in another preferred embodiment of the present invention, at least one weave pattern of machine direction warp yarns with minimal yarn float lengths is woven side by side.

The cross machine direction yarns form preferably at least one plain weave with a single weft in the same shed.

Alternatively, the cross machine direction yarns form at least one plain weave with multiple wefts in the same shed. Thereby, the void volume inside the structure of the fabric can range from 0 to 0.9 $mm^3$, preferably from 0 to 0.5 $mm^3$, and most preferably from 0 to 0.15 $mm^3$ for a path of warp yarn or a stacked warp yarn segment and/or the void volume at the surfaces of the fabric can range from 0.5 to 1.5 $mm^3$ and preferably from 0.75 to 1.0 $mm^3$. In summary, the void volume at the surfaces of the fabric and the void volume inside the structure of the fabric have preferably a ratio between 1:1 and 30:1 and preferably between 4:1 and 25:1.

And in another alternative, the machine direction yarns are vertically stacked in at least two systems.

Furthermore, in order to fill the void volume inside the structure of the fabric the dryer fabric preferably uses additional yarns with a yarn diameter between 0.10 and 0.40 mm.

In addition, the yarns possess preferably a high crimp level in the range of up to two times the vertical dimension of the warp yarn.

The yarns can also possess a high warp density, where the warp is not vertically stacked, by increasing the warp cover above 120%. The warp cover for two layers would then be 240%, whereas for three layers 360%. The warp cover is by definition the total number of ends per given width multiplied by the cross sectional width of the warp yarn, expressed as a percentage of the theoretical maximum attainable surface warp cover.

Aiming to increase crimp interchange between warp and weft to produce a denser fabric, the yarns possess preferably a high tension level due to crimp interchange from the effect of the heat setting machine of above 5 kg/cm.

Additionally, the yarns possess preferably a melting point below the material employed in a comparable parent fabric. The lower melting point material will flow into the interstices of the fabric structure while reducing the void volume inside the structure of the fabric. The melting point of the yarns is preferably between 90 and 240° C. This range is between the lowest running temperature of the fabric on the paper machine and the melting point of polyester.

The yarns can also be profiled, either singularly or in multiples, to fill the void volume inside the structure of the fabric.

And finally, preformed castellated wefts can be preferably used to fill the internal shape of the weave pattern.

BRIEF DESCRIPTION OF THE DRAWINGS

In order that the present invention may be more readily understood several preferred embodiments of the papermakers dryer fabric structure according to the invention will now be described by way of example with reference to the accompanying drawings wherein.

DETAILED DESCRIPTION

Figure 1:
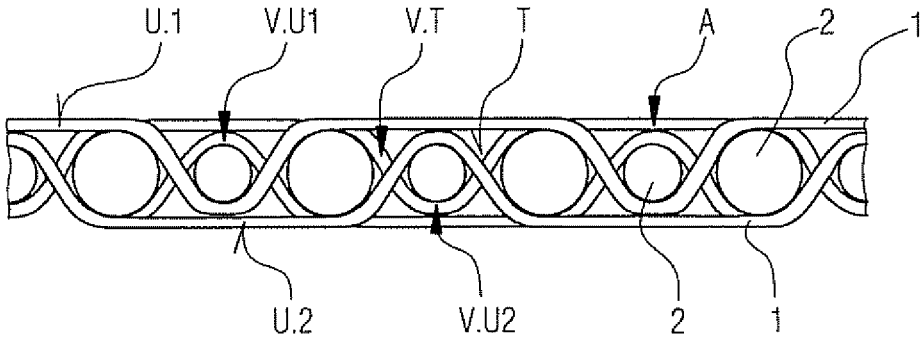
FIG. 1 shows a cross machine direction view of a first dryer fabric according to prior art.

FIG. 1 shows a cross machine direction view of a first dryer fabric A according to prior art. This fabric A is designed to carry a not shown paper web on one fabric surface and is woven from machine direction yarns 1 and cross machine direction yarns 2 wherein the yarns 1, 2 cross over each other to create void volume V.T, V.U1, V.U2 both inside the structure T of the fabric A and at the surfaces U.1, U.2 of the fabric A.

Figure 2:
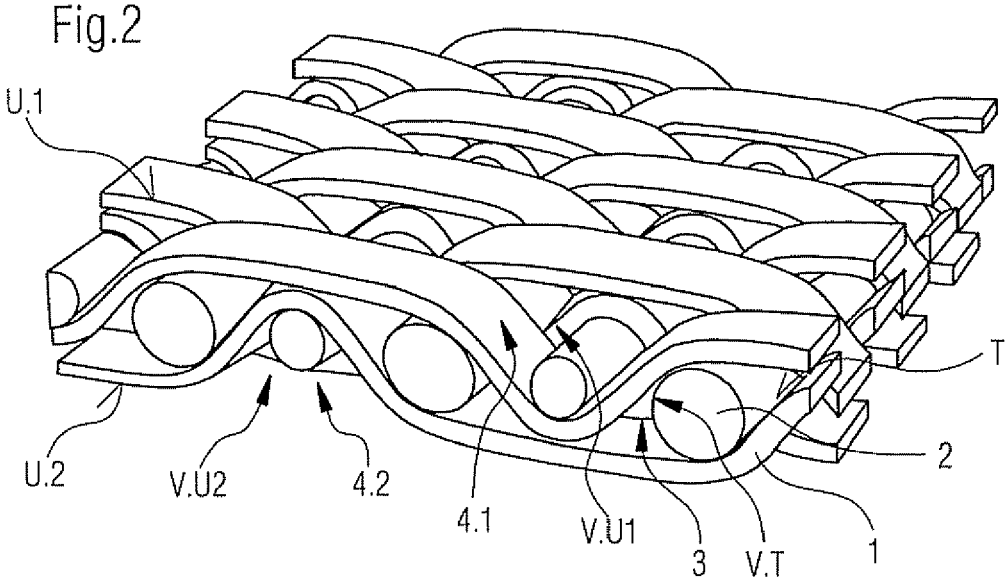
FIG. 2 further illustrates the first dryer fabric of FIG. 1.

FIG. 2 is a line drawing of a μ-CT scan of the first dryer fabric A of FIG. 1. This sample is tomographed with a μ-CT-machine, the objects are examined using software such as VGStudioMax to segment the path of a machine direction yarn 1 or stacked machine direction yarns in relation to the cross machine direction yarns 2. The total void volume of structural voids 3 and surface voids 4.1, 4.2 is then separated from the material section. The void volume V.T, V.U1, V.U2 of each void 3 inside the structure T of the fabric A and void 4.1, 4.2 at the surfaces U.1, U.2 of the fabric A is measured.

Figure 3:
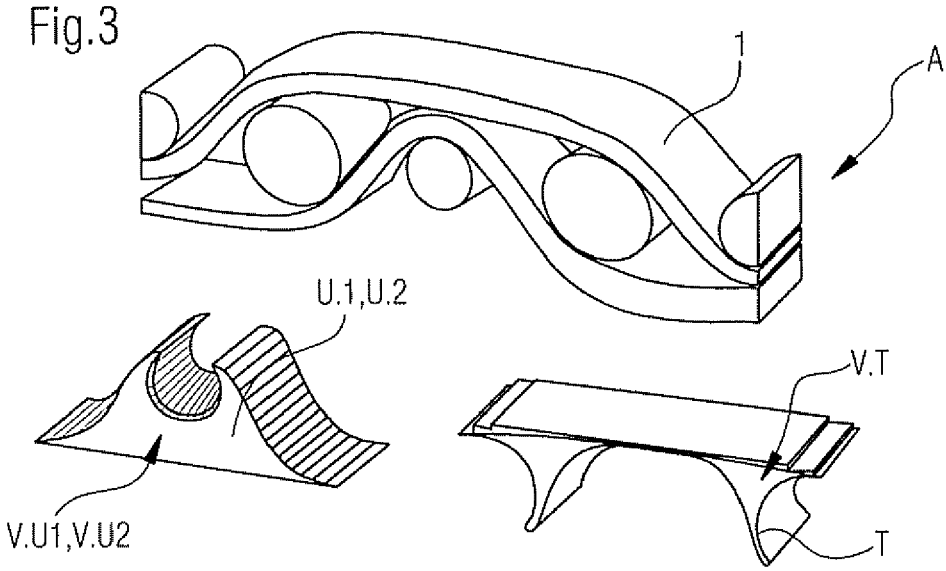
FIG. 3 is a segmentation of a pair of stacked machine direction warp yarns and segmentation of the surface and structural void volume of the first dryer fabric of FIG. 1.

FIG. 3 is a segmentation of a pair of stacked machine direction warp yarns 1 of the first dryer fabric A of FIG. 1. This segmentation has a calculated void volume V.T inside the structure T of the fabric A of 0.903 $mm^3$ and the void volume V.U1, V.U2 at the surfaces U.1, U.2 of the fabric A is calculated at 1.504 $mm^3$. Moreover, the ratio of void volume V.U1, V.U2 at the surfaces U.1, U.2 of the fabric A to void volume V.T inside the structure T of the fabric A is 1.67:1. In this example the fabric A has 3,468 segments in a 100×100 mm area, therefore the void volume V.T inside the structure T of the fabric A is 5,216 $mm^3$/100 $mm^2$ and void volume V.U1, V.U2 at the surfaces U.1, U.2 of the fabric A is 3,132 $mm^3$/100 $mm^2$.

Figure 4:
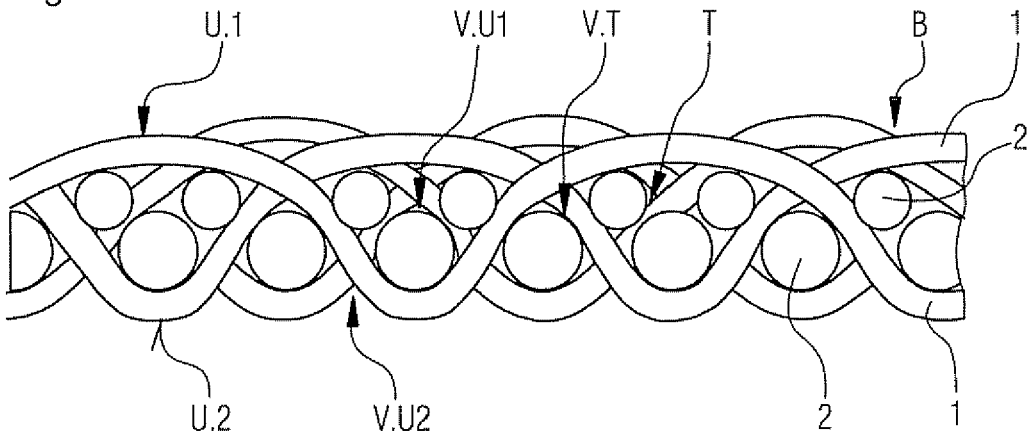
FIG. 4 shows a cross machine direction view of a second dryer fabric according to prior art.

FIG. 4 shows a cross machine direction view of a second dryer fabric B according to prior art. Also this fabric B is designed to carry a not shown paper web on one fabric surface and is woven from machine direction yarns 1 and cross machine direction yarns 2 wherein the yarns 1, 2 cross over each other to create void volume V.T, V.U1, V.U2 both inside the structure T of the fabric A, B and at the surfaces U.1, U.2 of the fabric B.

Figure 5:
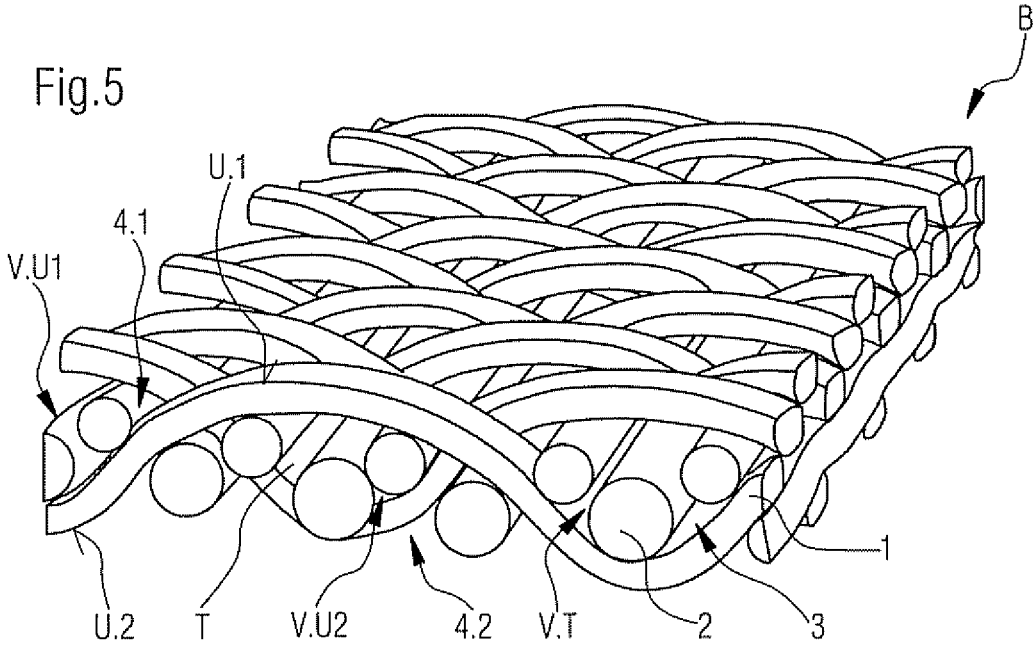
FIG. 5 further illustrates the second dryer fabric of FIG. 4.

FIG. 5 is a line drawing of a μ-CT scan of the second dryer fabric B of FIG. 4. This sample is also tomographed with a μ-CT-machine, the objects are examined using software such as VGStudioMax to segment the path of a machine direction yarn 1 or stacked machine direction yarns in relation to the cross machine direction yarns 2. The total void volume of structural voids 3 and surface voids 4.1, 4.2 is then separated from the material section. The void volume V.T, V.U1, V.U2 of each void 3 inside the structure T of the fabric B and void 4.1, 4.2 at the surfaces U.1, U.2 of the fabric B is measured.

Figure 6:
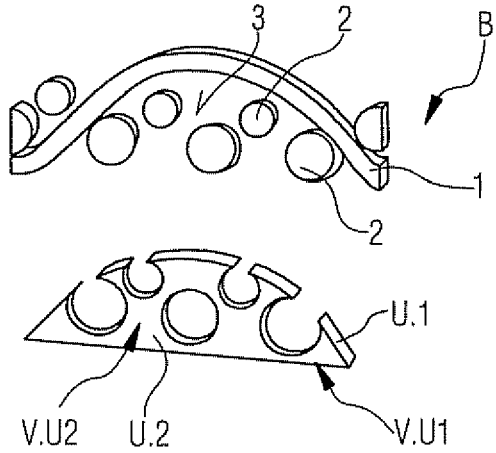
FIG. 6 is a segmentation of a machine direction warp yarn and segmentation of the surface and structural void volume of the second dryer fabric of FIG. 4.

FIG. 6 is a segmentation of a machine direction warp yarn 1 of the second dryer fabric B of FIG. 4. The segmentation is of void volume V.T inside the structure T of the fabric B between machine direction yarns 1 and cross machine direction yarns 2. These voids 3 are structural as they have an opening between their surfaces, where the said opening is narrower than the length of the shortest surface in the void 3. The segmentation is also of void volume V.U1, V.U2 at the surfaces U.1, U.2 of the fabric B.

Figure 7:
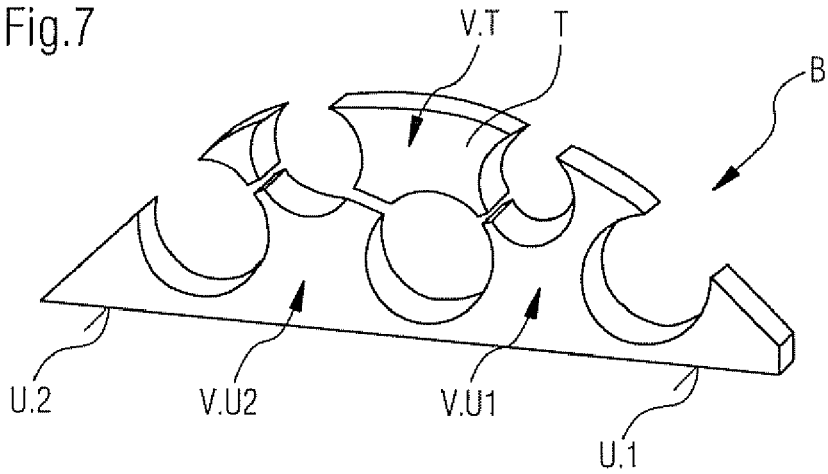
FIG. 7 is a definition of void volume inside the structure of the fabric and void volume at the surfaces of the fabric.

FIG. 7 is a definition of void volume V.T inside the structure T of the fabric B and void volume V.U1, V.U2 at the surfaces U.1, U.2 of the fabric B. The segmentation of void volume V.T inside the structure T of the fabric B between machine direction yarns 1 and cross machine direction yarns 2 can be seen. These voids 3 are structural as they have an opening between these surfaces, where the said opening is narrower than the length of the shortest surface in the void 3. Furthermore, the segmentation of void volume V.U1, V.U2 at the surfaces U.1, U.2 of the fabric B, C can also be seen.

The following FIGS. 8 to 14 show dryer fabrics according to the present invention. They have all in common that the machine direction yarns and the cross machine direction yarns of these fabrics are interlaced so that virtually all of the void volume is exposed to the paper web carrying and non-paper web carrying surfaces.

Figure 8:
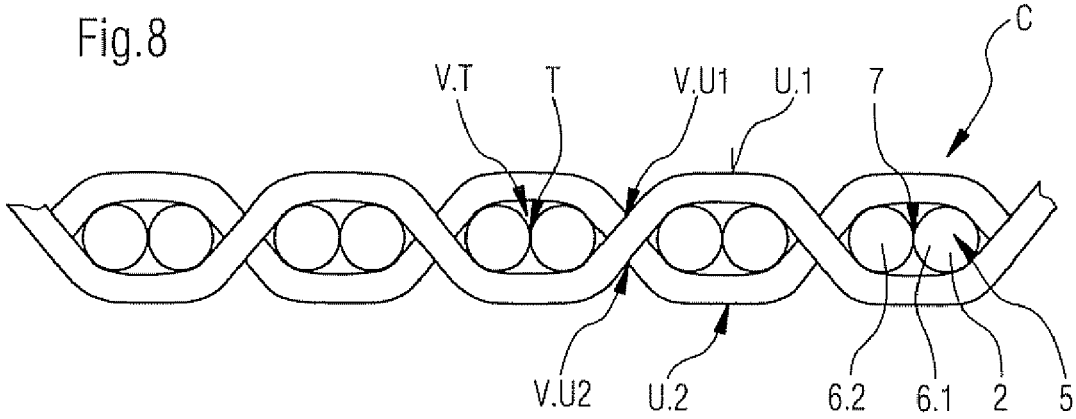
FIG. 8 shows a cross machine direction view of a first fabric according to the present invention.

FIG. 8 shows a cross machine direction view of a first fabric C according to the present invention. The cross machine direction yarns 2 form at least one plain weave 5 with multiple wefts 6.1, 6.2 in the same shed 7. The void volume V.U1, V.U2 at the surfaces U.1, U.2 of the fabric C is significant compared to the void volume V.T in the structure T of the fabric C.

Figure 9:
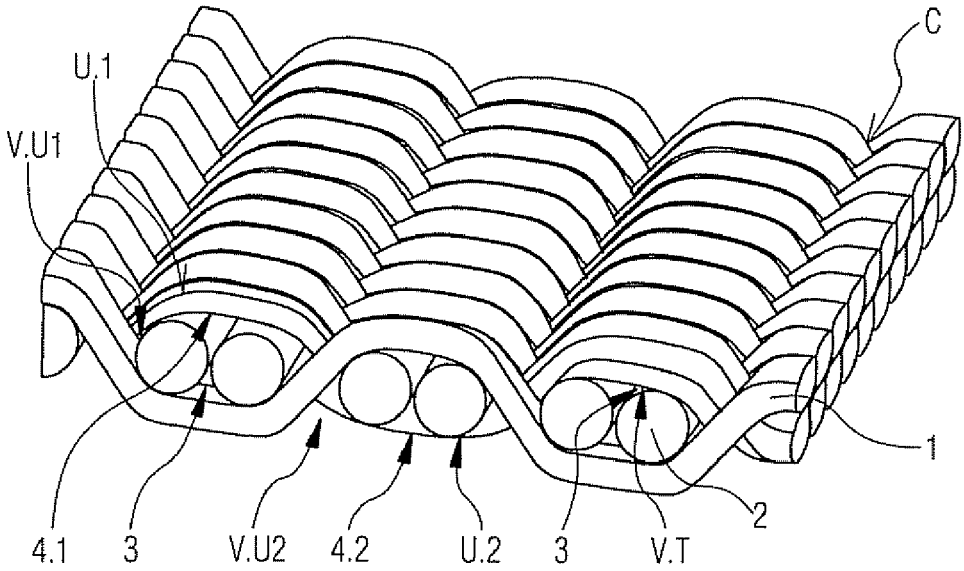
FIG. 9 further illustrates the first fabric according to the present invention.

FIG. 9 is a line drawing of a μ-CT scan of the first fabric C of FIG. 8. The sample is again tomographed with a μ-CT-machine, the objects are again examined using software such as VGStudioMax to segment the path of an machine direction yarn 1 or stacked machine direction yarns in relation to the cross machine direction yarns 2. The total void volume of structural voids 3 and surface voids 4.1, 4.2 is then again separated from the material section. The void volume V.T, V.U1, V.U2 of each void 3 inside the structure T of the fabric B and void 4.1, 4.2 at the surfaces U.1, U.2 of the fabric C is again measured.

Figure 10:
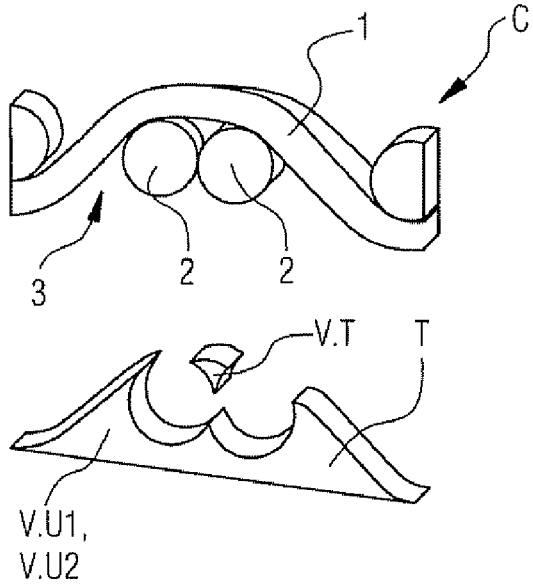
FIG. 10 is a segmentation of a machine direction warp yarn of the first fabric according to the present invention.

FIG. 10 is a segmentation of a machine direction warp yarn 1 of the first fabric C of FIG. 8. The segmentation is of void volume V.T inside the structure T of the fabric C between machine direction yarns 1 and cross machine direction yarns 2. These voids 3 are surface as they have an opening between their surfaces, where the said opening is wider than the length of the shortest surface in the void 3. The segmentation is also of void volume V.U1, V.U2 at the surfaces of the fabric C.

The void volume V.T inside the structure T of the fabric C ranges from 0 to 0.9 $mm^3$, preferably from 0 to 0.5 $mm^3$, and most preferably from 0 to 0.15 $mm^3$ for a path of warp yarn or a stacked warp yarn segment and/or the void volume V.U1, V.U2 at the surfaces of the fabric C ranges from 0.5 to 1.5 $mm^3$ and preferably from 0.75 to 1.0 $mm^3$. The calculated value for the shown fabric C are: calculated void volume V.T inside the structure T of the fabric C of 0.023 $mm^3$ and calculated void volume V.U1, V.U2 at the surfaces of the fabric C of 0.927 $mm^3$.

Furthermore, the void volume V.U1, V.U2 at the surfaces of the fabric C and the void volume V.T inside the structure T of the fabric C have a ratio between 1:1 and 30:1 and preferably between 4:1 and 25:1. The ratio for the shown fabric C has been calculated at 4.03:1.

In this shown example, the fabric C has 8,100 segments in 100×100 mm area, therefore the void volume V.T inside the structure T of the fabric C is 186.3 $mm^3$/100 $mm^2$ and void volume V.U1, V.U2 at the surfaces of the fabric C is 7,508 $mm^3$/100 $mm^2$.

Figure 11:
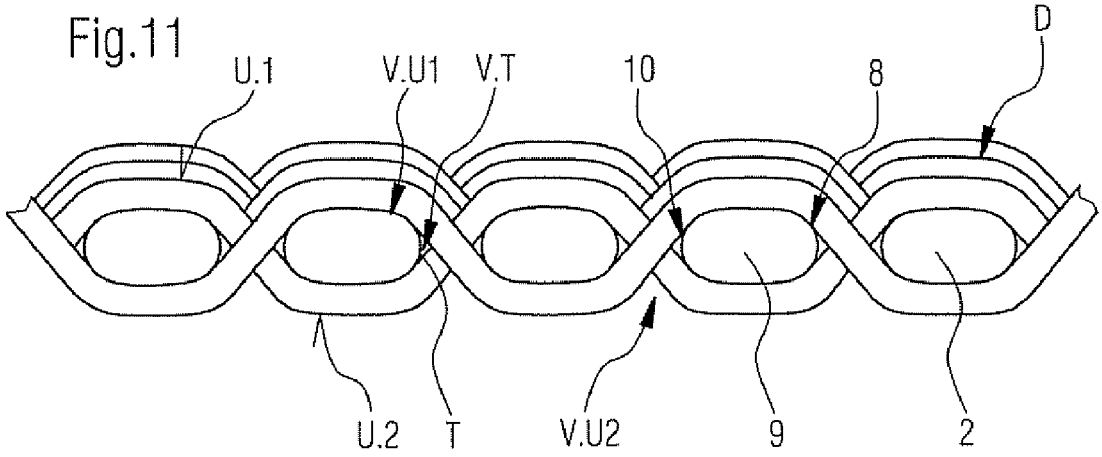
FIG. 11 shows a cross machine direction view of a second fabric according to the present invention.

FIG. 11 shows a cross machine direction view of a second fabric D according to the present invention. The cross machine direction yarns 2 form at least one plain weave 8 with a single weft 9 in the same shed 10. The void volume V.U1, V.U2 at the surfaces U.1, U.2 of the fabric D is significant compared to the void volume V.T in the structure T of the fabric D.

Figure 12:
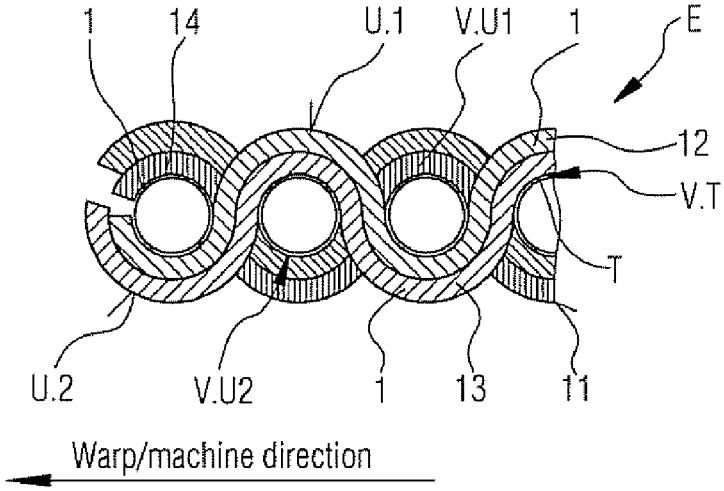
FIG. 12 is a sketch showing a cross machine direction view of a third fabric according to the present invention.

FIG. 12 is a sketch showing a cross machine direction view of a third fabric E according to the present invention. The machine direction yarns 1 are vertically stacked in at least two systems, presently in four systems 11 to 14. Again, the void volume V.U1, V.U2 at the surfaces U.1, U.2 of the fabric E is significant compared to the void volume V.T in the structure T of the fabric E.

Figure 13:
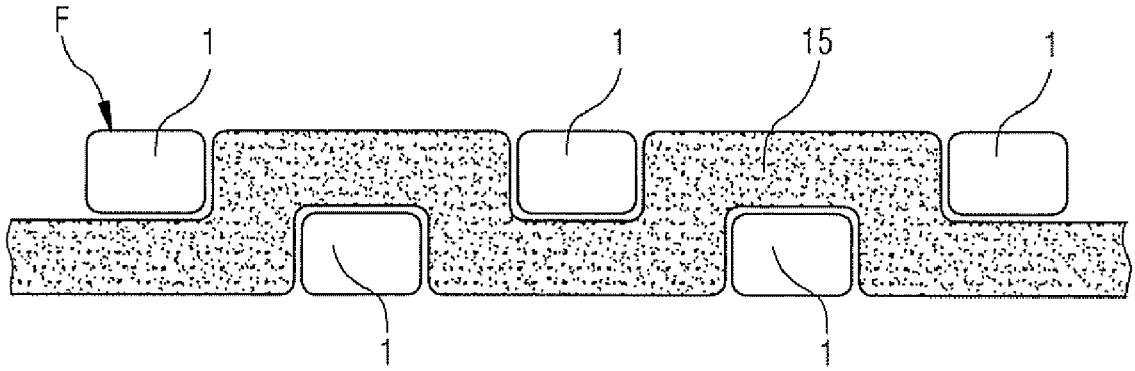
FIG. 13 is a sketch showing a preformed castellated cross machine direction weft yarn according to the present invention.

FIG. 13 is a sketch showing a preformed castellated cross machine direction weft yarn 15 of another fabric F according to the present invention. This shown weft yarn 15 is used to fill the internal shape of the weave pattern of machine direction warp yarns 1 and preformed castellated cross machine direction weft yarn 15.

Figure 14:
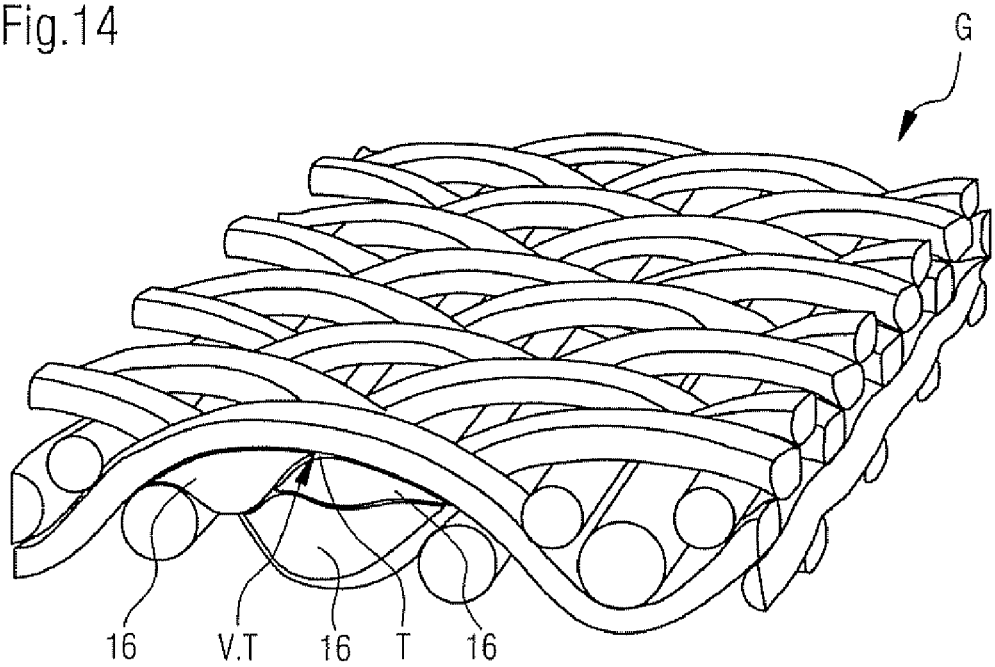
FIG. 14 is a sketch showing a profiled cross machine direction weft yarn according to the present invention.

FIG. 14 is a sketch showing a profiled cross machine direction weft yarn 16 according to the present invention. This shown weft yarn 16 would be extruded in a cross sectional shape to fill the void volume V.T inside the structure T of the fabric G in the fabric G.

The inventive fabrics C to G are additionally in common that internal void volume V.T beneath at least one layer of a machine direction yarn 1 and inside the structure T of the fabric C to G ranges from 0 to 0.9 $mm^3$, preferably from 0 to 0.5 $mm^3$ and most preferably from 0 to 0.05 $mm^3$ and/or that the void volume V.T inside the structure T of the fabric C to G ranges from 0 to 3,000 $mm^3$/100 $mm^2$ and preferably from 0 to 250 $mm^3$/100 $mm^2$. The void volume V.U1, V.U2 at the surfaces U.1, U.2 of the fabric C to G ranges from 0 to 10,000 $mm^3$/100 $mm^2$ and preferably from 2,500 to 10,000 $mm^3$/100 $mm^2$.

The additional weft yarns 2 have a yarn diameter between 0.10 and 0.40 mm in order to fill the void volume V.T inside the structure T of the fabric C to G and have a high crimp level in the range of up to two times the vertical dimension of the warp yarn 1. Furthermore, the yarns 1 possess a high warp density, where the warp is not vertically stacked, by increasing the warp cover above 120% and possess a high tension level due to crimp interchange from the effect of the heat setting machine of above 5 kg/cm. Thereby, the yarns possess a melting point below the material used in a comparable parent fabric, which is between 90 and 240° C.

REFERENCE NUMERALS LIST

1 machine direction yarn
2 cross machine direction yarn
3 structural void
4.1 surface void
4.2 surface void
5 weave
6.1 weft
6.2 weft
7 shed
8 weave
9 weft
10 shed
11 system
12 system
13 system
14 system
15 castellated cross machine direction weft yarn
16 profiled cross machine direction weft yarn
A first dryer fabric (prior art)
B second dryer fabric (prior art)
C first dryer fabric (invention)
D second dryer fabric (invention)
E third dryer fabric (invention)
F fourth dryer fabric (invention)
G fifth dryer fabric (invention)
T structure
U.1 surface
U.2 surface
V.T void volume
V.U1 void volume
V.U2 void volume

The invention claimed is:

1. A papermakers dryer fabric (C to G) having paper web carrying and non-paper web carrying surfaces (U.1, U.2), the fabric being adapted to carry a paper web on the paper web carrying surface and woven from machine direction yarns (1) and cross machine direction yarns (2; 6.1, 6.2; 15, 16) wherein the yarns (1, 2; 6.1, 6.2; 15, 16) cross over each other to create void volume (V.T, V.U1, V.U2) both inside the structure (T) of the fabric (C to G) and at the surfaces (U.1, U.2) of the fabric (C to G), wherein the machine direction yarns (1) and the cross machine direction yarns (2; 6.1, 6.2; 15, 16) are interlaced so that virtually all of the void volume (V.U1, V.U2) is exposed to the paper web carrying and non-paper web carrying surfaces (U.1, U.2), wherein the machine direction yarns and the cross machine direction yarns are substantially round in cross section, wherein the void volume (V.U1, V.U2) at the surfaces (U.1, U.2) of the fabric (C to G) ranges from 0 to 10,000 $mm^3$/100 $mm^2$, and wherein the void volume (V.U1, V.U2) at the surfaces (U.1, U.2) of the fabric (C) and the void volume (V.T) inside the structure (T) of the fabric (C) have a ratio between 1:1 and 30:1.

2. A papermakers dryer fabric (C to G) according to claim 1, wherein the void volume (V.T) beneath at least one layer of a machine direction yarn (1) and inside the structure (T) of the fabric (C to G) ranges from 0 to 0.9 $mm^3$.

3. A papermakers dryer fabric (C to G) according to claim 1, wherein the void volume (V.T) beneath at least one layer of a machine direction yarn (1) and inside the structure (T) of the fabric (C to G) ranges from 0 to 0.5 $mm^3$.

4. A papermakers dryer fabric (C to G) according to claim 1, wherein the void volume (V.T) beneath at least one layer of a machine direction yarn (1) and inside the structure (T) of the fabric (C to G) ranges from 0 to 0.05 $mm^3$.

5. A papermakers dryer fabric (C to G) according to claim 1, wherein the void volume (V.T) beneath at least one layer of a machine direction yarn (1) and inside the structure (T) of the fabric (C to G) ranges from 0 and 3,000 $mm^3$/100 $mm^2$.

6. A papermakers dryer fabric (C to G) according to claim 1, wherein the void volume (V.T) beneath at least one layer of a machine direction yarn (1) and inside the structure (T) of the fabric (C to G) ranges from 0 to 250 $mm^3$/100 $mm^2$.

7. A papermakers dryer fabric (C to G) according to claim 1, wherein the void volume (V.U1, V.U2) at the surfaces (U.1, U.2) of the fabric (C to G) ranges from 2,500 to 10,000 $mm^3$/100 $mm^2$.

8. A papermakers dryer fabric (C to G) according to claim 1, wherein at least one weave pattern of machine direction warp yarns (1) with minimal yarn float lengths is woven side by side.

9. A papermakers dryer fabric (C to G) according to claim 1, wherein the cross machine direction yarns (2) form at least one plain weave (8) with a single weft (9) in the same shed (10).

10. A papermakers dryer fabric (C to G) according to claim 1, wherein the cross machine direction yarns (2) form at least one plain weave (5) with multiple wefts (6.1, 6.2) in the same shed (7).

11. A papermakers dryer fabric (C to G) according to claim 10, wherein the void volume (V.T) inside the structure (T) of the fabric (C) ranges from 0 to 0.9 $mm^3$ for a path of warp yarn or a stacked warp yarn segment.

12. A papermakers dryer fabric (C to G) according to claim 10, wherein the void volume (V.T) inside the structure (T) of the fabric (C) ranges from 0 to 0.5 $mm^3$ for a path of warp yarn or a stacked warp yarn segment.

13. A papermakers dryer fabric (C to G) according to claim 10, wherein the void volume (V.T) inside the structure (T) of the fabric (C) ranges from 0 to 0.15 $mm^3$ for a path of warp yarn or a stacked warp yarn segment.

14. A papermakers dryer fabric (C to G) according to claim 10, wherein the void volume (V.U1, V.U2) at the surfaces (U.1, U.2) of the fabric (C) ranges from 0.5 to 1.5 $mm^3$.

15. A papermakers dryer fabric (C to G) according to claim 10, wherein the void volume (V.U1, V.U2) at the surfaces (U.1, U.2) of the fabric (C) ranges from 0.75 to 1.0 $mm^3$.

16. A papermakers dryer fabric (C to G) according to claim 11, wherein the void volume (V.U1, V.U2) at the surfaces (U.1, U.2) of the fabric (C) and the void volume (V.T) inside the structure (T) of the fabric (C) have a ratio between 4:1 and 25:1.

17. A papermakers dryer fabric (C to G) according to claim 1, wherein the machine direction yarns (2) are vertically stacked in at least two systems (11 to 14).

18. A papermakers dryer fabric (C to G) according to claim 1, wherein additional yarns (1, 2; 6.1, 6.2; 15; 16) with a yarn diameter between 0.10 and 0.40 mm are used to fill the void volume (V.T) inside the structure (T) of the fabric (C to G).

19. A papermakers dryer fabric (C to G) according to claim 1, wherein the yarns (2; 6.1, 6.2; 15; 16) possess a high crimp level in the range of up to two times the vertical dimension of the warp yarn (1).

20. A papermakers dryer fabric (C to G) according to claim 1, wherein the yarns (2; 6.1, 6.2; 15; 16) possess a high warp density, where the warp is not vertically stacked, by increasing the warp cover above 120%.

21. A papermakers dryer fabric (C to G) according to claim 1, wherein the yarns (2; 6.1, 6.2; 15; 16) possess a high tension level due to crimp interchange from the effect of the heat setting machine of above 5 kg/cm.

22. A papermakers dryer fabric (C to G) according to claim 1, wherein the yarns (2; 6.1, 6.2; 15; 16) possess a melting point between 90 and 240° C.

23. A papermakers dryer fabric (C to G) according to claim 1, wherein the yarns (16) are profiled, either singularly or in multiples, to fill the void volume inside the structure of the fabric.

24. A papermakers dryer fabric (C to G) according to claim 1, wherein preformed castellated wefts (15) are used to fill the internal shape of the weave pattern.

25. A papermakers dryer fabric according to claim 10, wherein the cross machine direction yarns which define multiple wefts in the same shed contact each other.

* * * * *